US008511494B2

(12) United States Patent
Rometty et al.

(10) Patent No.: US 8,511,494 B2
(45) Date of Patent: Aug. 20, 2013

(54) FOUR-SIDED CONTAINER

(75) Inventors: John A. Rometty, Barrington, IL (US); Jeffrey W. O'Hara, Cherry Valley, IL (US); Lloyd W. Lenig, Plymouth, IN (US)

(73) Assignee: Illinois Tool Works Inc., Glenview, IL (US)

( * ) Notice: Subject to any disclaimer, the term of this patent is extended or adjusted under 35 U.S.C. 154(b) by 221 days.

(21) Appl. No.: 12/720,774

(22) Filed: Mar. 10, 2010

(65) Prior Publication Data

US 2010/0243648 A1 Sep. 30, 2010

Related U.S. Application Data

(60) Provisional application No. 61/165,361, filed on Mar. 31, 2009.

(51) Int. Cl.
*B65D 6/28* (2006.01)
*B65D 8/14* (2006.01)

(52) U.S. Cl.
USPC ..... 220/4.01; 220/666; 220/676

(58) Field of Classification Search
USPC ..... 229/931, 117.01, 122.32; D9/433, D9/432, 430; 220/4.23, 4.22, 4.21, 4.01, 220/623; 493/162
IPC ..... B65D 8/14, 90/02
See application file for complete search history.

(56) References Cited

U.S. PATENT DOCUMENTS

| | | | | |
|---|---|---|---|---|
| 1,228,132 | A * | 5/1917 | Nagle | 362/118 |
| 1,288,132 | A * | 12/1918 | Nagle | 229/100 |
| 1,582,541 | A * | 4/1926 | Ringer | 220/62 |
| 2,173,927 | A * | 9/1939 | Allen | 493/338 |
| 2,274,765 | A * | 3/1942 | Zalkind | 428/133 |
| 3,173,596 | A | 3/1965 | Aust et al. | |
| 3,445,052 | A * | 5/1969 | Lewallen | 428/158 |
| 3,817,371 | A * | 6/1974 | Gatter | 206/0.5 |
| 3,887,101 | A * | 6/1975 | Adachi | 220/4.29 |

(Continued)

FOREIGN PATENT DOCUMENTS

| | | |
|---|---|---|
| EP | 1016596 A1 | 7/2000 |
| FR | 2416850 A2 | 9/1979 |
| FR | 2899880 A1 | 10/2007 |

OTHER PUBLICATIONS

International Search Report and Written Opinion of the International Searching Authority issued on Jun. 14, 2010 in connection with PCT/US2010/027490.

*Primary Examiner* — Robert J Hicks

(74) *Attorney, Agent, or Firm* — Levenfeld Pearlstein, LLC

(57) ABSTRACT

A four-sided, clam-shell-like container is formed from a pre-formed, rigid U-shaped cross-section. The U-shaped member has a base wall and opposing side walls. The base and side walls and the intersection of the base and side walls are rigid. The base wail has a thickness having a slot is formed therein. The slot extends longitudinally along a length of the base wall and is formed in an inner surface thereof into the thickness of the base wall. The slot defines base wall sections adjacent and connected to one another by a portion of the thickness of the base wail. The base wall portions and the side walls adjacent thereto are foldable inward along the slot so as to form a four-sided, generally rectangular shaped cross-section container such that ends of the side walls are near one another and are foldable outward for stacking and storing the U-shaped members.

6 Claims, 1 Drawing Sheet

(56) References Cited

U.S. PATENT DOCUMENTS

| | | | | |
|---|---|---|---|---|
| 4,234,080 | A | 11/1980 | Gellert | |
| 6,457,636 | B1 * | 10/2002 | Van de Ven et al. | 229/122.32 |
| 6,609,628 | B2 * | 8/2003 | Tattam | 220/592.26 |
| 2003/0150904 | A1 * | 8/2003 | Machery | 229/165 |
| 2004/0086692 | A1 * | 5/2004 | Clark | 428/166 |
| 2004/0089703 | A1 * | 5/2004 | Gosis et al. | 229/122.32 |
| 2007/0063006 | A1 * | 3/2007 | Kruelle et al. | 229/122.34 |
| 2010/0187147 | A1 * | 7/2010 | Rometty et al. | 206/517 |

* cited by examiner

FOUR-SIDED CONTAINER

CROSS-REFERENCE TO RELATED APPLICATION

This application claims the benefit of priority of Provisional U.S. Patent Application Ser. No. 61/165,361, filed Mar. 31, 2009, entitled "FOUR-SIDED CRATE".

BACKGROUND OF THE INVENTION

The present invention is directed to rigid, crate-based packaging containers. More particularly, the present invention pertains to rigid, packaging containers that reduce the number of elements and amount of material needed for the containers.

Packaging takes many forms. One widely popular construction includes a pair of laminated paperboard top and bottom U-shaped members or channels, the U-shaped members configured for one fit within the other to form a crate. These packages have become a standard for objects that are linear and/or readily damaged. One well-recognized and industry-acclaimed package is the REDDI-CRATE®, commercially available from ITW Reddi-Pac of Lake Zurich, Ill.

Although the crates themselves are extremely successful, one drawback is that the each crate requires a pair of U-shaped members and as such a fairly substantial amount of material. Two individual U-shaped members are required (a "top and a bottom" or "cover and base"), which constitutes six total panels—three panels for each of the cover and the base. In addition, there is considerable overlap on the sides of the cover and base crates resulting in excessive material.

To reduce the number of U-shaped members and material needed, one known packaging is a five-sided package in which each side is attached to its adjacent side by a portion of the thickness of package material. Effectively each panel is "loosely hinged" to each adjacent panel. While this does in fact reduce the amount of material needed, it does not provide a structurally rigid container, nor one of high integrity.

In addition, the crates must be shipped and stored in an assembled form. As such, the material costs, shipping costs, and storage costs (and space) can be quite substantial, in large measure because so much of the empty crate is air. This can be problematic as the crates become larger in sectional area and length.

Accordingly, there exists a need for a type of container that reduces the number of individual members needed to create the container and that uses less material for the container. Desirably, such a configuration has little to no adverse effect on the strength and integrity of the container as it is used for shipping goods.

BRIEF SUMMARY OF THE INVENTION

A four-sided, clam-shell-type container is formed from a preformed, rigid U-shaped member having a generally U-shaped cross-section. The U-shaped member has a base wail and opposing side walls. The base wall and side walls and the intersection of the base wall and side walls are rigid. The base wall has a thickness and an opening or a slot formed therein.

The opening or slot formed in the base wall extends longitudinally along a length of the base wall and is formed in an inner surface thereof into the thickness of the base wall. The slot defines opposing base wall sections adjacent and connected to one another by a portion of the thickness of the base wall. The base wall portions and the side walls adjacent thereto, which are rigid relative to one another, are closable or foldable inward, in a clam-shell-like manner, along slot so as to form a four-sided, generally rectangular-shaped cross-section container such that lateral ends of each of the side walls are brought into proximity or near one another.

The slot can be formed in the base, about mid-way between the side walls for which the crate has a substantially square cross-section. Alternately, the slot is formed in the base non-equidistant between the side walls, and the crate has a substantially rectangular, non-square cross-section. In a present U-shaped member, the slot extends through about 75 percent to about 85 percent of the base wall thickness and has a width of about 155 percent of the thickness of the base wall.

The U-shaped members (i.e. the base wall portions and the side walls adjacent thereto) are openable or foldable outward along the slot so as to form a generally M-shaped cross-section.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
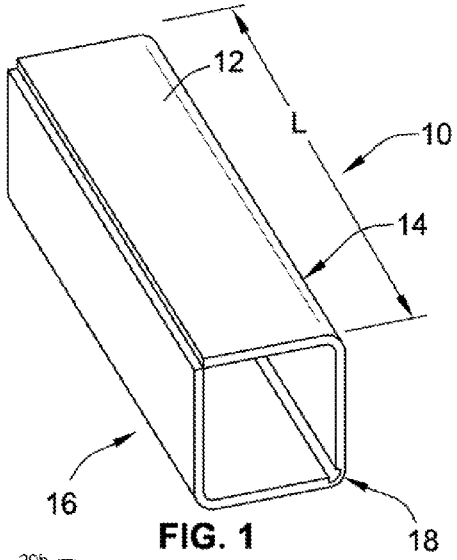
FIG. 1 is perspective view of a four sided, clam-shell type packaging container embodying the principles of the present invention.

While the present invention is susceptible of embodiment in various forms, there is shown in the drawings and will hereinafter be described presently preferred embodiments with the understanding be that the present disclosures are to be considered exemplifications of the invention and are not intended to limit the invention to the specific embodiments illustrated.

It should be further understood that the title of this section of this specification, namely, "Detailed Description Of The Invention," relates to a requirement of the United States Patent Office, and does not imply, nor should be inferred to limit the subject matter disclosed herein.

Figure 5A:
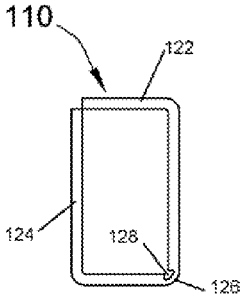
FIGS. 5A and 5B illustrate an embodiment of the packaging container with a rectangular cross-section.
Figure 5B:
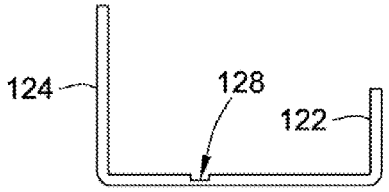

A present four-sided, clam-shell-like container ("container"), is configured to enclose an object. The container is formed, for example, from a REDDI-CRATE® commercially available from ITW Reddi-Pac of Lake Zurich, Ill. The container can be positioned in three configurations: an initial configuration (FIGS. 3,5B), a closed configuration (FIGS. 1, 2, 5A), and an open configuration (FIG. 4).

Figure 2:
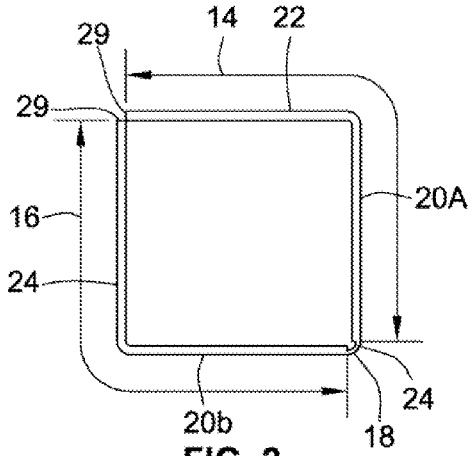
FIG. 2 is an end view of the packaging container of FIG. 1 in the closed or packing configuration.
Figure 3:
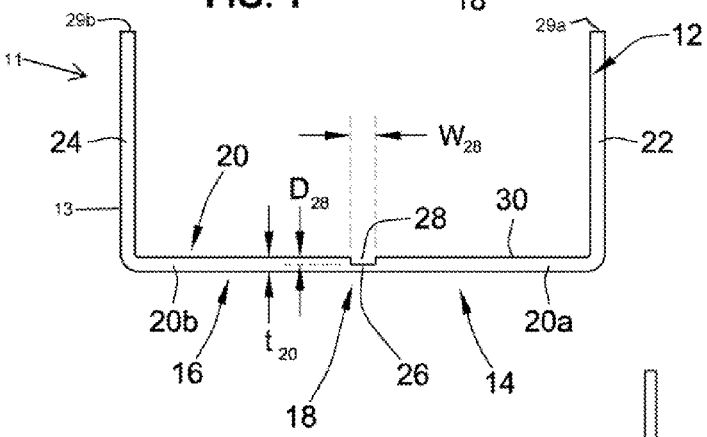
FIG. 3 is an end view of the packaging container of FIG. 2 in the initial configuration.
Figure 4:
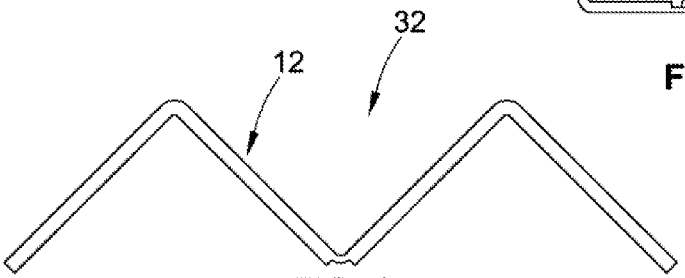
FIG. 4 is an end view of the packaging container of FIG. 2 in an open configuration that permits stacking, example, for shipping and storage.

Referring now to FIGS. 1-3, the container 10 is formed, in an initial configuration, as a single U-shaped member 11, having a U-shaped cross-section, from a laminated paperboard product. The U-shaped member 11 has a base wall 20, and two sidewalls 22, 24. An outer surface 12 of the U-shaped member 11 can have a liquid-resistant coating 13, such as a claycoat. Other member and coating materials can, of course, be used.

The container 10 also has a channel or slot 28 formed longitudinally along the center of the base wall 20 along a length of the base wall 20. The slot 28 is formed into the inner wall 30 of the base wall 20, partitioning the base wall 20 into two portions or sections 20*a*, 20*b*. The two sections 20*a* and 20*b* remain integral and continuous with one another by base material portion 26. In a present container 10, the slot 28 is formed having a width $W_{28}$ of about 155 percent (155%) of the crate wall caliper $t_{20}$ and depth $D_{28}$ of about 75 percent (75%) to 85 percent (85%) of the wall caliper. Those skilled in the art will recognize the ways in which such a slot can be formed, such as by routing, cutting, or compressing. In addition, the slot 28 may be formed in the center of the base wall 20 or anywhere along the length of the base wall 20.

The U-shaped member 11 is closable or foldable inward along the slot 28 in a clam-shell-like manner to form container 10. "Clam-shell-like" refers to walls 22, 24, and partition sections 20*a*, 20*b* remaining rigid and also hingedly movable relative to one another at slot 28.

When in the closed configuration (FIGS. 1 and 2), the lateral or free ends 29*a*, 29*b* of the sidewalls 22, 24 respectively, are positioned near or adjacent to one another and may abut. The closed container 10 includes two pairs of rigidly connected sides or halves 14, 16 as shown by arrows in FIG. 2) with the halves 14, 16 hingedly connected to one another as indicated at 18. As seen in FIG. 2, each pair half 14, 16 of container 10 is essentially formed as a rigid angle (from an intersection of the partitioned sections 20*a*, 20*b* and rigidly formed adjacent sidewall 22, 24, respectively) with the two halves 14, 16 integral and connected to one another by portion 26 of the base wall 20 of the container 10 material.

Containers having different cross-sections are also contemplated. For example, the container 10 illustrated in FIGS. 1 and 2 has a slot 28 formed in the center of the base wall 20, mid-way between the sidewalk 22, 24 creating a container 10 having a substantially square cross-section as shown in FIGS. 1 and 2. In another embodiment, the container 110 can be formed having a rectangular cross-section (shown in FIGS. 5A, 5B) by having one side wall taller 124 than the other sidewall 122 and by moving the slot 128 toward the taller sidewall 124 in order to create a container 110 having a rectangular cross-section.

In a third or open configuration, as shown in FIG. 4, the U-shaped member 11 can be foldable outward or opened to form an M-shape (indicated at 32), which allows the U-shaped members to be stacked or nested with like members. This allows for an increase in the density of the container elements for storage and shipping, thus providing an economical and effective arrangement for such container elements.

The advantages of the present four-sided, clam-shell-type container will be appreciated by those skilled in the art. It will be appreciated that the structural integrity of the package conies, in part, from the strength of the corners. A present tour sided, clam-shell-type container eliminates the overlap of the sidewalls of the previous art while still providing, a rigid and structurally sound container. It has been found that even though the base wall has a slot formed therein, this thickness and depth does not appreciably reduce the strength of the package nor the integrity of the package. The container exhibits about 89 percent to 93 percent of the strength of a non-slotted container.

The container has been shown to be extremely strong, having a high degree of structural integrity, which can be enhanced using a coating. An outer wall coating may provide liquid resistance (weather-proofing) to the container materials. In addition, having the slot formed into the inner wall of the base keeps the outer coated surface unaffected, thus enabling the container to retain its liquid resistant properties.

Furthermore, the present container reduces material waste and is a cost-effective solution for packaging.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it will be observed that numerous modifications and variations can be effected without departing from the true spirit and scope of the novel concepts of the present invention, it is to be understood that no limitation with respect to the specific embodiments illustrated is intended or should be inferred. The disclosure is intended to cover by the appended claims all such modifications as fall within the scope of the claims.

What is claimed is:

1. A four-sided container comprising:

a preformed, rigid U-shaped member having a U-shaped cross-section, the U-shaped member having a base wall and opposing side walls, the opposing side walls each having, a free end, the base wall and side walls and an intersection of the base wall and side walls being rigid, the base wall having an outer surface, a thickness, and having an open slot formed therein, the open slot extending continuously longitudinally along the base wall and formed in an inner surface thereof into the thickness of the base wall, the open slot extending from the inner surface, through about 75 percent to about 85 percent of the base wall thickness, the open slot defining base wall sections adjacent and connected to one another by a portion of the thickness of the base wall, the outer surface of the base wall being substantially smooth, the base wall portions and the side walls adjacent thereto foldable inward along the open slot such that the opposing side wall free ends lie adjacent to one another so as to form a four-sided, generally rectangular shaped cross-section container, and wherein the base wall portions and the side walls adjacent thereto are foldable outward along the open slot so as to form a generally M-shaped cross-section.

2. The container in accordance with claim 1 wherein the slot has a width of about 155 percent of the thickness of the base wall.

3. The container in accordance with claim 1 wherein the open slot is formed in the base, about mid-way between the side walls.

4. The container in accordance with claim 3 wherein the container has a substantially square cross-section.

5. The container in accordance with claim 1 wherein the open slot is formed in the base, non-equidistant between the side walls.

6. The container in accordance with claim 5 wherein the container has a substantially rectangular, non-square cross-section.

* * * * *

UNITED STATES PATENT AND TRADEMARK OFFICE

CERTIFICATE OF CORRECTION

PATENT NO. : 8,511,494 B2
APPLICATION NO. : 12/720774
DATED : August 20, 2013
INVENTOR(S) : John A. Rometty, Jeffrey W. O'Hara and Lloyd W. Lenig It is certified that error appears in the above-identified patent and that said Letters Patent is hereby corrected as shown below:

On the Title Page

Item (57) in the abstract, the phrase "The base wail has a thickness having a slot..." should read "The base wall having a thickness slot...". Later in the abstract, the phrase "...of the thickness of the base wail." should read "...of the thickness of the base wall.".

Signed and Sealed this
Twenty-fourth Day of June, 2014

Michelle K. Lee

Michelle K. Lee
*Deputy Director of the United States Patent and Trademark Office*